US005490093A

United States Patent [19]

Koepke

[11] Patent Number: 5,490,093

[45] Date of Patent: Feb. 6, 1996

[54] METHOD FOR ENHANCING COMPUTER CONTROLLED MISSILE PERFORMANCE

[75] Inventor: Keith A. Koepke, Canoga Park, Calif.

[73] Assignee: Hughes Aircraft Company, Los Angeles, Calif.

[21] Appl. No.: 195,661

[22] Filed: Feb. 9, 1994

Related U.S. Application Data

[63] Continuation of Ser. No. 688,394, Apr. 22, 1991, abandoned.

[51] Int. Cl.[6] ..... F41G 9/00

[52] U.S. Cl. ..... 364/571.01; 364/551.01; 364/423; 244/3.15

[58] Field of Search ..... 364/550, 552, 364/571.01, 571.02, 423, 424.02, 551.01; 244/3.14, 3.15

[56] References Cited

U.S. PATENT DOCUMENTS

| | | | |
|---|---|---|---|
| 4,935,881 | 6/1990 | Lowenson et al. | 364/550 |
| 5,016,198 | 5/1991 | Schreiber | 364/571.02 |
| 5,036,479 | 7/1991 | Prednis et al. | 364/571.02 |
| 5,048,771 | 9/1991 | Siering | 244/3.15 |

*Primary Examiner*—Emanuel T. Voeltz
*Assistant Examiner*—Kyle J. Choi

[57] ABSTRACT

A computer controlled apparatus, such as a missile (10), has its various operational characteristics precisely measured at a test station (16), for example. The apparatus data processor software (14) is then modified so as to enable accessing process correction or compensation data and the apparatus program memory is reprogrammed with personalized operational characteristics for the given apparatus. In use, the software (14) compensates to achieve operation based upon actual apparatus characteristics rather than unassumed values averaged from manufacturing tolerances.

5 Claims, 1 Drawing Sheet

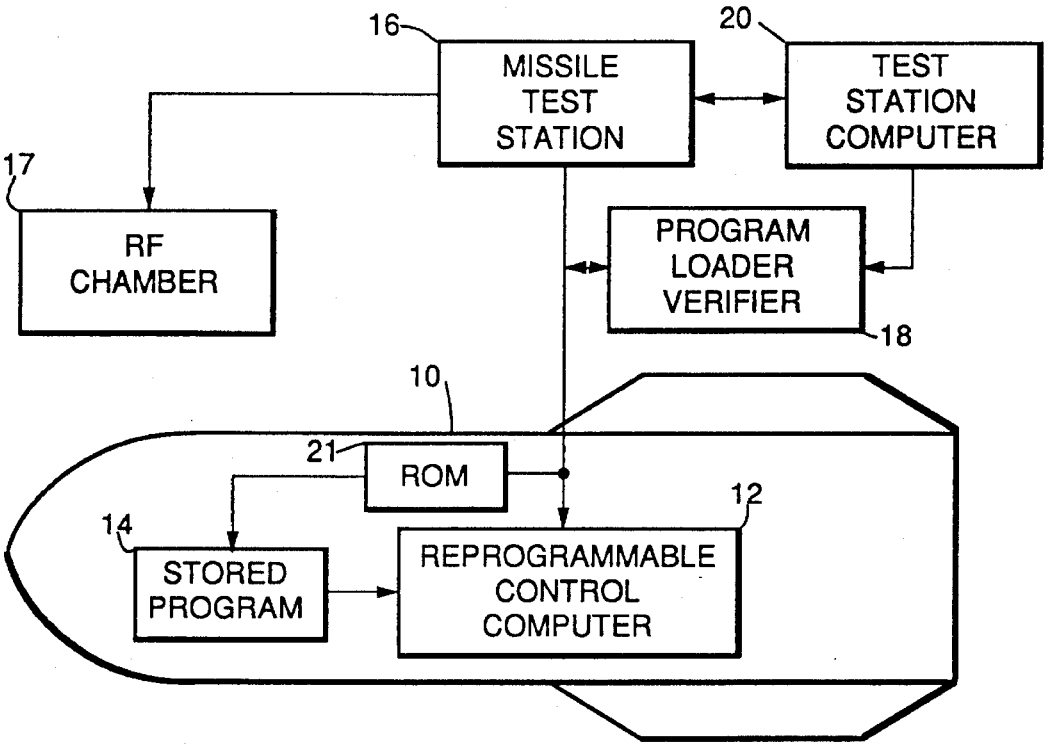
FIG. 1.
FIG. 2.
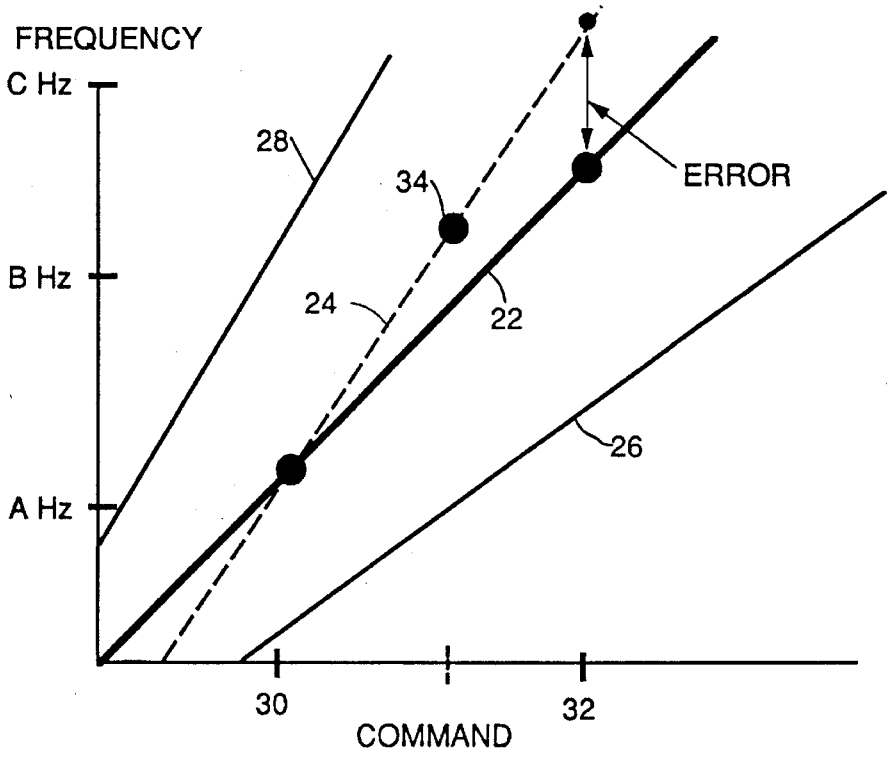

METHOD FOR ENHANCING COMPUTER CONTROLLED MISSILE PERFORMANCE

This is a continuation of application Ser. No. 07/688,394 filed Apr. 22, 1991 now abandoned.

BACKGROUND

1. Field of the Invention

The present invention relates generally to computer controlled apparatus such as a missile, for example, and, more particularly, to a method for enhancing such apparatus performance at the time of Use.

2. Description of Related Art

Although the present invention is believed to provide beneficial results when used with other computer controlled apparatus, it is considered to be especially advantageous for use with a missile and will be particularly described in that connection. The various apparatus parts of a missile at the present time have relatively tight tolerance requirements which are reflected by corresponding manufacturing cost in maintaining the tolerances and loss occasioned by reject materials and apparatus which exceed the tolerance ranges. In computer control of a missile, the tolerances of the hardware must be such that worst case errors of all of the apparatus units involved have to be close enough to the software expected nominal value in order to insure that a specified performance is obtained. This means that if some part of the hardware is outside the limits of tolerance it must be rejected because it will not provide the required performance with the given missile software.

Also, there are many cases where hardware tolerances cannot be reasonably controlled. For example, in certain cases, a launch cycle time calibration must be performed in order to measure a given hardware performance characteristic. Such a calibration reduces the error between the hardware and the software expected value, however, it does not entirely eliminate the error. Still further, many of the measurements taken during calibration are noisy and can be corrupted by external interference, however, additional time cannot usually be taken to reduce the measurement noise because frequently the calibration at launch must be made within a specific time window. Additionally, computer software being used has to make certain assumptions concerning the hardware operation which may not be accurate where there is an inability to make a direct measurement of the hardware.

OBJECT AND SUMMARY OF THE PRESENT INVENTION

It is accordingly a primary aim and object of the present invention to overcome tolerance restriction in operation of a computer controlled missile by providing an additional program memory that modifies operation according to the personal and precise characteristics of the hardware for any given missile.

As a first step in the practice of the method of the present invention, the various hardware characteristics of a given missile system to be utilized are measured. Measuring of the characteristics preferably takes place at a missile test station having the requisite control, power and test equipment. In carrying this out, a special test software program is loaded into the missile data processor via its verifier, for example. A sister program is executed by the station computer, for example, to make station measurements, control missile stimulus and to collect output data from the computer of the missile. The characteristics of the given missile system being measured can include a considerable number of items and no attempt will be made to set forth an exhaustive listing of these items. Examples of these characteristics are: mode-to-mode gain, channel-to-channel phase and gain, angle versus range, angle boresight shift versus frequency, to name a few.

After the measurements are taken, a further step in the method is to modify the data processor flight software for the missile so that it can read an additional program memory for accessing process correction or compensation data. Then the missile computer program memory is reprogrammed with the modified flight software and the processed hardware characteristic data resulting in personalized data for this particular missile now being stored in the missile for use at execution time. Finally, on missile launch, the software reads the special program memory and compensates the observed data to achieve operation based upon actual apparatus characteristics rather than assumed (and, therefore, erroneous) ones.

In the event a chassis is replaced or parts are introduced into the system, this would merely require for practicing the present invention to reload the special test software, measure the new characteristics and reprogram the missile with it.

DESCRIPTION OF THE DRAWINGS

In the accompanying drawings:

FIG. 1 is a schematic function block diagram of a missile test station interrelated with a missile to practice the method of the present invention; and FIG. 2 is a graph of commands versus frequency of operation of a voltage control crystal oscillator illustrating use of the invention for that apparatus component.

DESCRIPTION OF A PREFERRED EMBODIMENT

With reference now to the drawing and particularly FIG. 1, the apparatus with which the method of this invention is to be particularly described is a missile 10 typically including a reprogrammable control computer 12. In the usual case, the missile and its various parts are constructed at one or more manufacturing facilities with the various hardware operational characteristics being provided within respective ranges of tolerance. In turn, on assembly of the missile the computer 12 is programmed to function and control from a stored program 14 assuming predetermined values for the apparatus operational characteristics which will differ, in most cases, from the actual apparatus operational characteristics in differing amounts. Typically, the characteristics are assumed by the program 14 to be the average of values across the respective tolerance ranges. By functioning on assumed, rather than actual, characteristics this results in operational errors that will vary from missile to missile.

As a first step in the method of this invention, the operational characteristics of each missile system must be determined and this is most readily and preferably accomplished in a missile test station 16 including an RF chamber 17 necessary for certain tests. This could be accomplished by loading a special test program into the missile data processor via a program loader verifier 18, for example. A sister program would also be executed by the test station computer 20 to make the required measurements to control missile stimulus, and to collect output data from the missile computer.

All of these measurements are then processed and arranged into a convenient format for the missile computer software program 14 to utilize (e.g., read-only memory 21).

Next, the flight portion of program 14 and computer 12 are modified to read the station computer 20 memory in order to access the correction or compensation data resulting from the personalized missile system measurements taken. Then, the missile computer program 14 memory is reprogrammed with the modified flight software including the personalised hardware characteristics data.

Accordingly, at launch the software will now access modified or compensated characteristics data from the program memory rather than assumed values. The result is optimized performance for each missile system with the errors in assumed characteristics operation being eliminated.

For the ensuing description of the invention being applied to compensate operation of a voltage controlled crystal oscillator (not shown) reference is now made to FIG. 2 which is a graph of hardware command versus frequency response for such an oscillator. Assumed response curve 22 is shown as a solid heavy centrally located line, the actual measured oscillator response is the dash line 24, and the two outer lines 26 and 28 depict the tolerance limits, respectively.

As shown, the assumed curve is an average of the tolerance limit values so that when the missile software commands a specified frequency, the response can be a value greater or less than the assumed amount depending upon the actual characteristics of the particular missile system. For example, with the software at command A enumerated 30, the oscillator frequency would be A Hz since the actual and assumed graphs cross at that value. If a command 32 is made to go to B frequency the system would expect to go to B Hz; however, since the actual characteristics differ from the assumed ones, C Hz is obtained instead. This results in an error equal to the difference between B Hz and C Hz. It is, therefore, a tolerance restraint on the system that the tolerance range be sufficiently tight so that any error from this source does not prevent the missile performing its function.

When the invention is being utilized, on the software seeking frequency B it looks up the modified command that will achieve point 34 on the actual curve 24 which provides the desired B Hz. In this, the error between assumed and actual response has been eliminated.

On utilization of the present invention, an existing computer controlled apparatus, the parts of which have performance characteristics that are to be found throughout known manufacturing tolerance range, can be optimized in its performance by eliminating any error caused by discrepancies between actual values of characteristics and those assumed by the computer. Not only is the apparatus operational efficiency enhanced, but it now becomes possible to increase the manufacturing tolerances on the apparatus parts without sacrificing overall operational efficiency. As a usual result, making tolerances less stringent desirably reduces manufacturing costs.

Although the invention has been described in connection with a preferred embodiment, it is to be understood that one skilled in the appertaining art may make modifications that come within the spirit of the invention and the scope of the claims.

What is claimed is:

1. A method of providing increased operational efficiency of a missile that is controlled by a computer that is coupled to a program memory, said missile having initial operational characteristics that are a function of parameters that lie within predetermined tolerance ranges, and said computer operating in accordance with a computer program that is initially programmed to control the missile based upon assumed values of the operational characteristics that correspond to average values of the parameters, said method comprising the steps of measuring actual operational characteristics of the missile to produce measured values corresponding thereto; generating correction factors that are indicative of the difference between the assumed values and the measured values; storing the correction factors in the program memory of the missile; and modifying the computer program so that during operation of the missile it accesses the stored correction factors to control the missile so that the missile is operated in accordance with the measured values.

2. A method as in claim 1, in which the modifying step includes storing program instructions that are based on the measured operational characteristics of the apparatus in a read only memory, and retrieving the stored program instructions for use with computer program operating in the computer.

3. A method as in claim 2, in which the missile comprises the computer and the read only memory.

4. A method as in claim 3, in which measuring of the missile operational characteristics is accomplished using a missile test station.

5. A method as in claim 2, in which the operational characteristics are selected from a group consisting of mode to mode gains, automatic gain coupling, voltage controlled crystal oscillator output, phase commands versus frequency and attenuator setting, channel to channel phase and gain, antenna gain, missile flight angle versus range, antenna boresight shift versus frequency, angle discriminates thermal noise level, random error slope table versus frequency, and direct current offset level.

* * * * *